US006123305A

United States Patent [19]

Lukasavitz

[11] Patent Number: 6,123,305

[45] Date of Patent: Sep. 26, 2000

[54] PIVOT BRACKET ASSEMBLY

[76] Inventor: Jeffrey J. Lukasavitz, 802 7th Ave. North, Sauk Rapids, Minn. 56379

[21] Appl. No.: 09/176,848

[22] Filed: Oct. 22, 1998

[51] Int. Cl.[7] ..... A47B 96/06

[52] U.S. Cl. ..... 248/292.12; 248/514; 403/97

[58] Field of Search ..... 248/292.12, 291.1, 248/299.1, 514, 539, 289.11, 290.1; 343/713, 715, 880, 881, 882; 403/24, 97

[56] References Cited

U.S. PATENT DOCUMENTS

| | | | |
|---|---|---|---|
| 981,979 | 1/1911 | Collins | 403/97 |
| 1,342,659 | 6/1920 | Wright | 248/292.12 |
| 1,995,656 | 3/1935 | Stout | 248/292.12 |
| 4,917,343 | 4/1990 | Wainscott | 248/291.1 X |
| 5,190,390 | 3/1993 | Ming-Tai | 403/24 |
| 5,445,355 | 8/1995 | Chen | 248/514 |
| 5,547,305 | 8/1996 | Treche | 403/97 |

OTHER PUBLICATIONS

World Wide Web page from online catalog of "Newton Instrument Company, Inc." Dated Aug. 2, 1999, Butner, N.C. p. 31.

*Primary Examiner*—Ramon O. Ramirez
*Assistant Examiner*—Gwendolyn Baxter

[57] ABSTRACT

A new pivot bracket assembly for mounting items, such as coaxial cable and microwave waveguide, to a structure such as an antenna. The device includes a pair of disks with each disk having a generally circular hole therethrough. The inner faces of the disks are positioned adjacent each other with the holes of the disks coaxial to each other. The threaded portion of a threaded fastener is extended through the holes of the disks such that the head portion of the threaded fastener is positioned adjacent the outer surface of one of the disks and the threaded portion extends outwardly from the outer face of the other of the disks. A nut is threaded on the threaded portion of the threaded fastener to hold the disks together. The outer surface of each of the disks has an angle arm outwardly extending therefrom. Each of the angle arms has a generally circular hole therethrough.

1 Claim, 4 Drawing Sheets

PIVOT BRACKET ASSEMBLY

BACKGROUND OF THE INVENTION

1. Field of the Invention

The present invention relates to mounting brackets and more particularly pertains to a new pivot bracket assembly for mounting items, such as coaxial cable and microwave waveguide, to a structure such as an antenna.

2. Description of the Prior Art

The use of mounting brackets is known in the prior art. More specifically, mounting brackets heretofore devised and utilized are known to consist basically of familiar, expected and obvious structural configurations, notwithstanding the myriad of designs encompassed by the crowded prior art which have been developed for the fulfillment of countless objectives and requirements.

Known prior art mounting brackets include U.S. Pat. No. 4,755,830; U.S. Pat. No. 5,566,916; U.S. Pat. No. 3,357,663; U.S. Pat. No. 3,503,580; U.S. Pat. No. 4,500,064; and U.S. Pat. No. Des. 357,922.

In use, mounting bracket assemblies are used to secure coaxial cable or microwave waveguide to a tower antenna structure. As the co-axial cable or microwave waveguide get closer to the top of the antenna structure, it becomes increasingly difficult to secure the cable to the antenna structure because of the unique angles, turns, and bends that are encountered. Similarly, unique angles, turns and bends are also encountered as the cable is routed to the transmitter building. Most prior art brackets extend out in a generally linear line so that the cable is held out in a straight line from the structure. However, these prior art brackets make it difficult to secure cable to the structure when non straight angles, bends and turns are encountered.

While these devices fulfill their respective, particular objectives and requirements, the aforementioned patents do not disclose a new pivot bracket assembly. The inventive device includes a pair of disks with each disk having a generally circular hole therethrough. The inner faces of the disks are positioned adjacent each other with the holes of the disks coaxial to each other. The threaded portion of a threaded fastener is extended through the holes of the disks such that the head portion of the threaded fastener is positioned adjacent the outer surface of one of the disks and the threaded portion extends outwardly from the outer face of the other of the disks. A nut is threaded on the threaded portion of the threaded fastener to hold the disks together. The outer surface of each of the disks has an angle arm outwardly extending therefrom. Each of the angle arms has a generally circular hole therethrough.

In these respects, the pivot bracket assembly according to the present invention substantially departs from the conventional concepts and designs of the prior art, and in so doing provides an apparatus primarily developed for the purpose of mounting items, such as coaxial cable and microwave waveguide, to a structure such as an antenna.

SUMMARY OF THE INVENTION

In view of the foregoing disadvantages inherent in the known types of mounting brackets now present in the prior art, the present invention provides a new pivot bracket assembly construction wherein the same can be utilized for mounting items, such as coaxial cable and microwave waveguide, to a structure such as an antenna.

The general purpose of the present invention, which will be described subsequently in greater detail, is to provide a new pivot bracket assembly apparatus and method which has many of the advantages of the mounting brackets mentioned heretofore and many novel features that result in a new pivot bracket assembly which is not anticipated, rendered obvious, suggested, or even implied by any of the prior art mounting brackets, either alone or in any combination thereof.

To attain this, the present invention generally comprises a pair of disks with each disk having a generally circular hole therethrough. The inner faces of the disks are positioned adjacent each other with the holes of the disks coaxial to each other. The threaded portion of a threaded fastener is extended through the holes of the disks such that the head portion of the threaded fastener is positioned adjacent the outer surface of one of the disks and the threaded portion extends outwardly from the outer face of the other of the disks. A nut is threaded on the threaded portion of the threaded fastener to hold the disks together. The outer surface of each of the disks has an angle arm outwardly extending therefrom. Each of the angle arms has a generally circular hole therethrough.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new pivot bracket assembly apparatus and method which has many of the advantages of the mounting brackets mentioned heretofore and many novel features that result in a new pivot bracket assembly which is not anticipated, rendered obvious, suggested, or even implied by any of the prior art mounting brackets, either alone or in any combination thereof.

It is another object of the present invention to provide a new pivot bracket assembly which may be easily and efficiently manufactured and marketed.

It is a further object of the present invention to provide a new pivot bracket assembly which is of a durable and reliable construction.

An even further object of the present invention is to provide a new pivot bracket assembly which is susceptible of a low cost of manufacture with regard to both materials and labor, and which accordingly is then susceptible of low prices of sale to the consuming public, thereby making such pivot bracket assembly economically available to the buying public.

Still yet another object of the present invention is to provide a new pivot bracket assembly which provides in the apparatuses and methods of the prior art some of the advantages thereof, while simultaneously overcoming some of the disadvantages normally associated therewith.

Still another object of the present invention is to provide a new pivot bracket assembly for mounting items, such as coaxial cable and microwave waveguide, to a structure such as an antenna.

Yet another object of the present invention is to provide a new pivot bracket assembly which includes a pair of disks with each disk having a generally circular hole therethrough. The inner faces of the disks are positioned adjacent each other with the holes of the disks coaxial to each other. The threaded portion of a threaded fastener is extended through the holes of the disks such that the head portion of the threaded fastener is positioned adjacent the outer surface of one of the disks and the threaded portion extends outwardly from the outer face of the other of the disks. A nut is threaded on the threaded portion of the threaded fastener to hold the disks together. The outer surface of each of the disks has an angle arm outwardly extending therefrom. Each of the angle arms has a generally circular hole therethrough.

Still yet another object of the present invention is to provide a new pivot bracket assembly that allows securing of cable to a structure when the length of the cable is running in a non-perpendicular or straight angle from the structure. The pivot bracket assembly may be pivoted to permit securing of the cable to the structure at any angle.

Even still another object of the present invention is to provide a new pivot bracket assembly that helps better secure cable to a structure to help reduce the risk of damage of the cable from wind and weather extremities.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
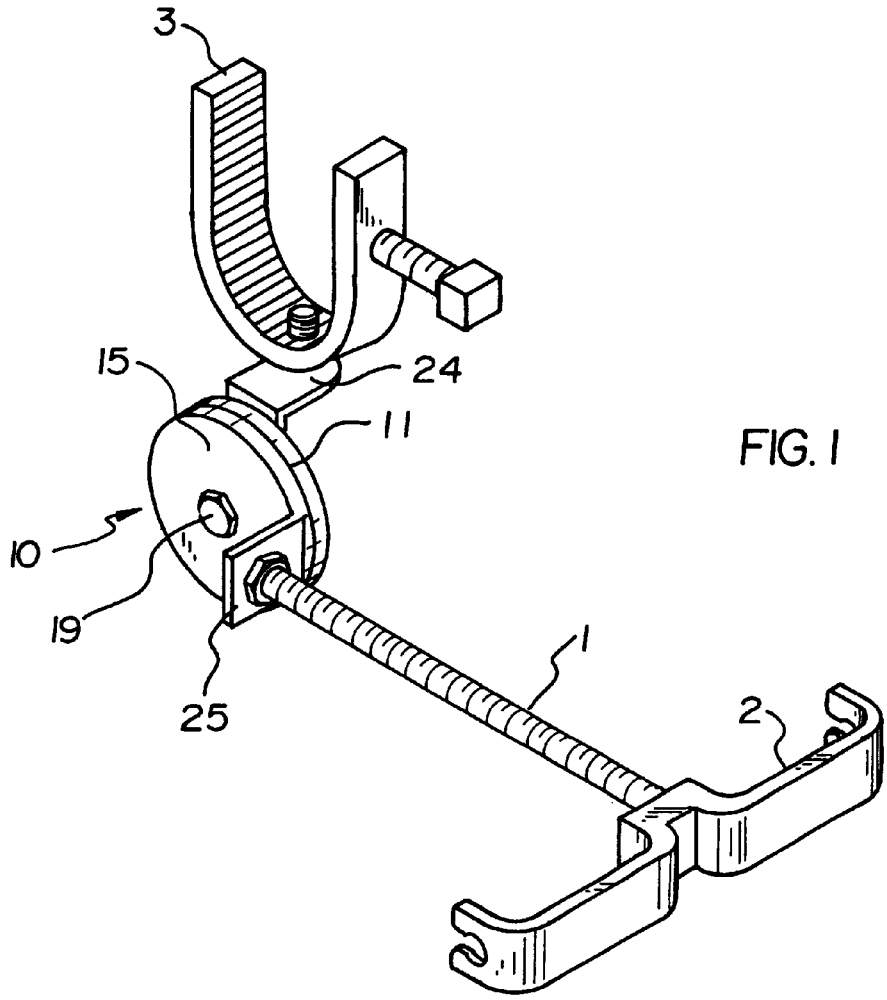
FIG. 1 is a schematic perspective view of a new pivot bracket assembly in use according to the present invention.
Figure 2:
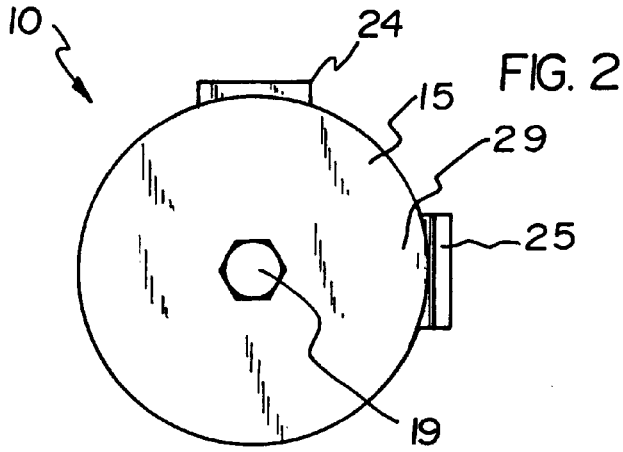
FIG. 2 is a schematic plan view of the present invention.
Figure 3:
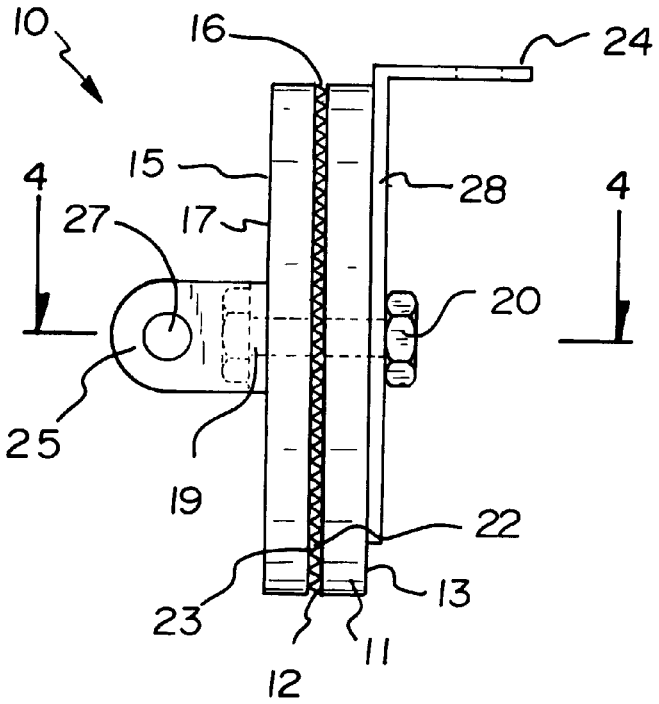
FIG. 3 is a schematic side view of the present invention.
Figure 4:
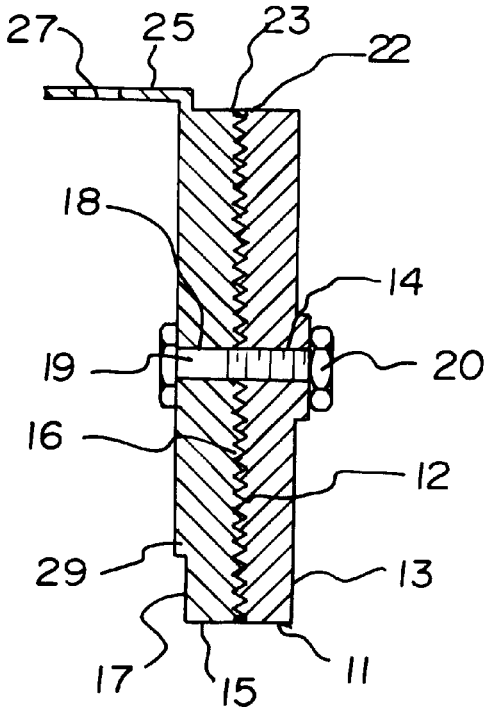
FIG. 4 is a schematic cross-sectional view of the present invention as seen from line 4—4 of FIG. 3.
Figure 5:
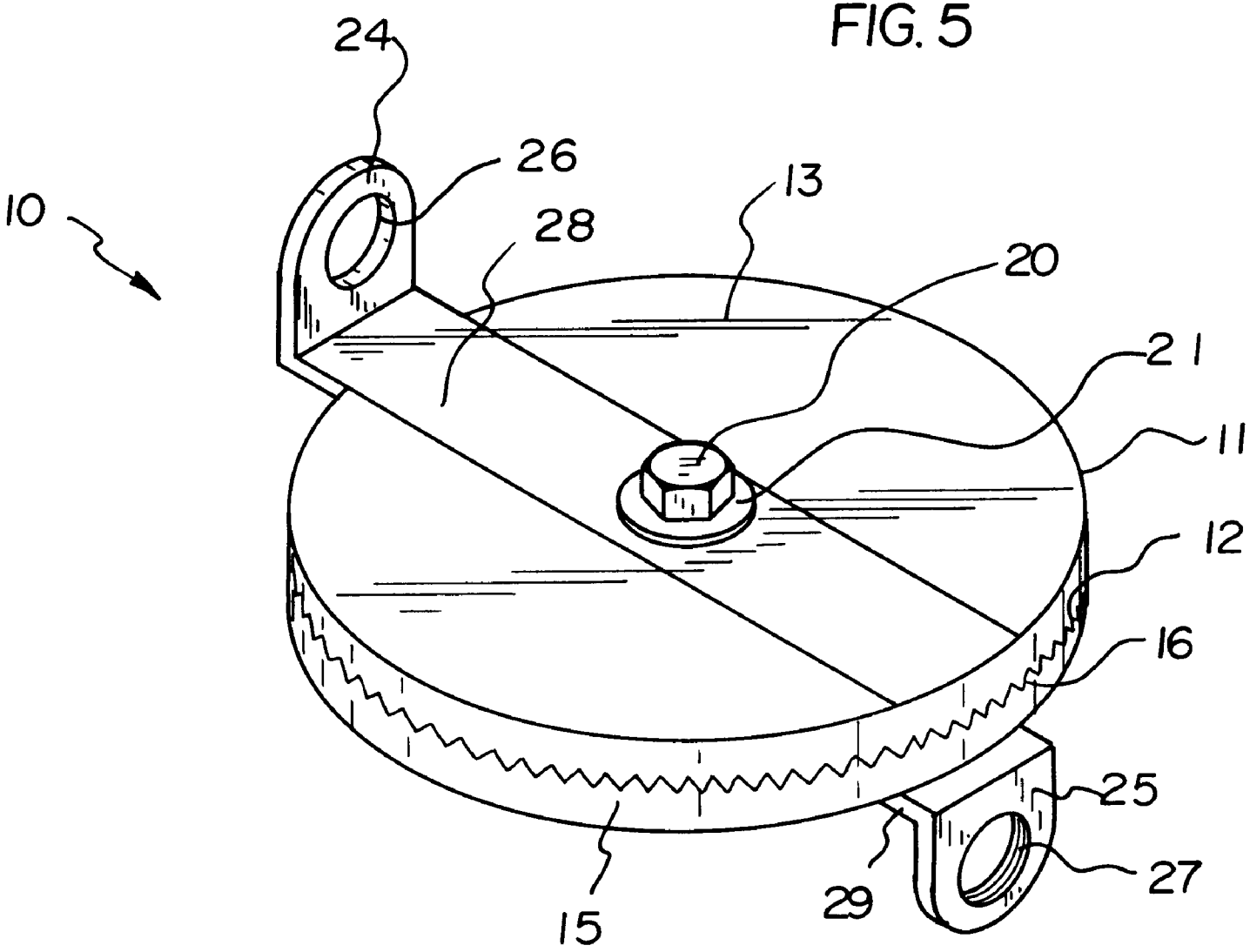
FIG. 5 is a schematic perspective view of the present invention.
Figure 6:
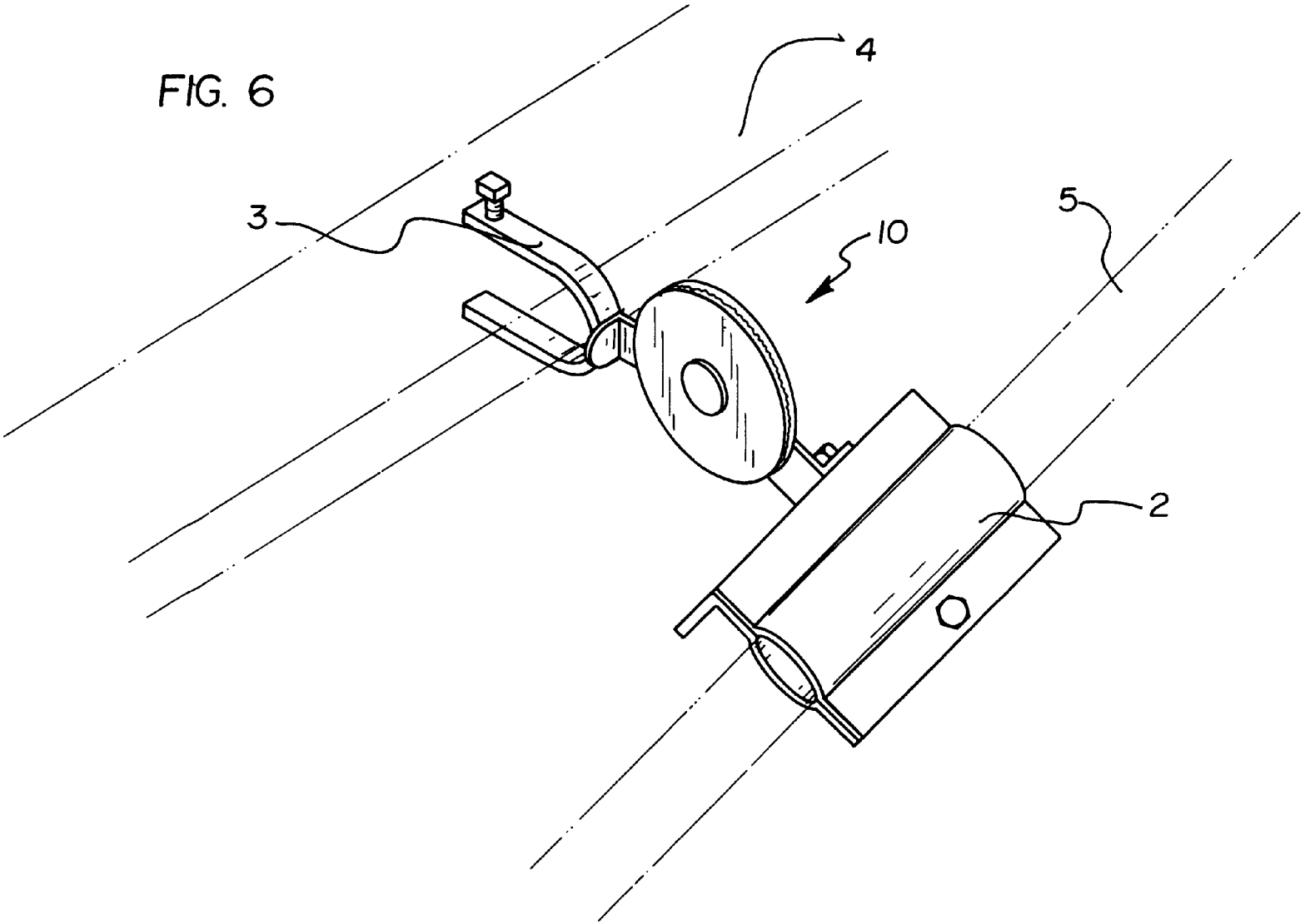
FIG. 6 is a schematic perspective view of the present invention in use securing a cable to a structure.

With reference now to the drawings, and in particular to FIGS. 1 through 6 thereof, a new pivot bracket assembly embodying the principles and concepts of the present invention and generally designated by the reference numeral 10 will be described.

As best illustrated in FIGS. 1 through 6, the pivot bracket assembly 10 generally comprises a pair of disks 11,15 with each disk having a generally circular hole 14,18 therethrough. The inner faces 12,13 of the disks are positioned adjacent each other with the holes 14,18 of the disks coaxial to each other. The threaded portion of a threaded fastener 19 is extended through the holes of the disks such that the head portion of the threaded fastener is positioned adjacent the outer surface of one of the disks and the threaded portion extends outwardly from the outer face of the other of the disks. A nut 20 is threaded on the threaded portion of the threaded fastener to hold the disks together. The outer surface 13,17 of each of the disks has an angle arm 24,25 outwardly extending therefrom. Each of the angle arms 24,25 has a generally circular hole 26,27 therethrough.

In closer detail, Each disk of the pair of disks 11,15 has a center, a diameter, an outer perimeter, and generally circular inner and outer faces 12,16,13,17. Each of the disks 11,15 has a generally circular hole 14,18 therethrough extending between the inner and outer faces of the disk. The hole 14,18 is preferably positioned at the center of the disk. The inner faces 12,16 of the disks are positioned adjacent each other such that the inner faces of the disks abut each other and the holes 14,18 of the disks are coaxial. Preferably, the diameter of each of the disks is greater than about 1 inch. In an ideal illustrative embodiment, the diameter of each of the disks is about 2½ inches.

A threaded fastener 19, preferably a bolt, has a head portion and a threaded portion. The threaded portion is extended through the holes of the disks such that the head portion of the threaded fastener is positioned adjacent the outer surface of one of the disks and the threaded portion extends outwardly from the outer face of the other of the disks. The threaded fastener 19 permits rotating of the disks 11,15 with respect to each other about the axis extending through the centers of the disks. A nut 20 is threaded on the threaded portion of the threaded fastener 19 to hold the disks 11,15 together between the nut and the head portion of the threaded fastener. Ideally, a washer 21 is disposed around the threaded portion of the fastener between the nut and the outer surface of the other disk. The inner face 12,16 of each of the disks preferably has a plurality of teeth ridges 22,23 tooled thereon. Each of the teeth ridges has a length extending radially outwards between the center and the outer perimeter of the disk. The teeth ridges 22 of one of the disks 11 mesh, that is engage, with the teeth ridges 23 of the other of the disks 15 when the inner faces of the disks abut each other. In use, the teeth ridges are designed for providing additional friction against rotation of the disks with respect to each other once the nut is tightened on the threaded fastener.

The outer surface 13,17 of each of the disks has an angle arm 24,25 outwardly extending therefrom. The angle arm is extended substantially perpendicular to the outer surface of the disk and the preferably positioned adjacent the outer perimeter of the disk. The angle arm of each of the disks preferably lies in a plane generally perpendicular to the diameter of the disk. Ideally, each of the angle arms 24,25 has an elongate attachment portion 28,29 coupling the angle arm to the outer surface of the associated disk. Each of the attachment portions lies in a plane generally parallel to the outer surface of the disk and generally perpendicular to the angle arm. Each of the angle arms has a generally circular hole 26,27 therethrough. Preferably, the hole 27 of one of the angle arms is threaded, that is, has a threaded periphery.

In use, the disks 11,15 are rotatable about the threaded fastener 19. So that the angle arms may be extended at any angle with respect to each other. The holes of the angle arms are designed for attaching items thereto by extending fasteners through the holes. For example, a threaded rod 1 of a waveguide/coaxial cable hanger 2 for holding cable 5 may be threadingly extended through the threaded hole 27 of one of the angle arms while an angle adapter 3 for attachment to a structure 4 (such as a tower antenna structure) may be secured to the other angle arm by another fastener extended through the hole of this angle arm;

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A pivot bracket assembly, comprising:

a pair of disks, each disk having a center, a diameter, an outer perimeter, and generally circular inner and outer faces;

each of said disks having a generally circular hole therethrough extending between said inner and outer faces of said disk, said hole of each disk being positioned at said center of said disk;

said inner faces of said disks being positioned adjacent each other such that said inner faces of said disks abut each other, said holes of said disks being coaxial;

a threaded fastener having a head portion and a threaded portion, said threaded portion being extended through said holes of said disks such that said head portion of said threaded fastener is positioned adjacent said outer surface of one of said disks and said threaded portion extends outwardly from said outer face of the other of said disks, said threaded fastener permitting rotating of said disks with respect to each other about the axis through said centers of said disks;

a nut being threaded on said threaded portion of said threaded fastener to hold said disks together between said nut and said head portion of said threaded fastener, wherein a washer is disposed around said threaded portion of said fastener between said nut and said outer surface of said other disk;

said inner face of each of said disks having a plurality of teeth ridges thereon, each of said teeth ridges having a length extending radially outwards between said center and said outer perimeter of said disk;

said teeth ridges of one of said disks meshing with said teeth ridges of the other of said disks when said inner faces of said disks abut each other, said teeth ridges being for providing additional friction against rotation of said disks with respect to each other once the nut is tightened on the threaded fastener;

each of said disks having a circular shape such that said perimeter of one of said disks is aligned with said perimeter of the other disk for preventing foreign objects from becoming pinched between said disks when said disks are rotated relative to one another;

said outer surface of each of said disks having an angle arm outwardly extending therefrom, said angle arm being extended substantially perpendicular to said outer surface of said disk, said angle arm being positioned adjacent said outer perimeter of said disk;

said angle arm of each of said disks lying in a plane generally perpendicular to the diameter of said disk;

each of said angle arms having a generally circular hole therethrough, said hole of said angle arm of one of said disks being threaded;

a first securing assembly mounted on a first one of the angle arms, the first securing assembly including a threaded rod having opposite end portions, a first end portion of the threaded rod extending through the hole in the first angle arm, and a waveguide hanger mounted on a second end portion of the threaded rod, the coaxial cable hanger comprising a central portion and a pair of oppositely extending arms mounted on the central portion, each of the arms having a free end with a retaining tab mounted thereon and extending substantially parallel to the threaded rod; and a second securing assembly mounted on a second one of the angle arms, the second securing assembly including an angle adapter for attachment to a tower structure, the angle adapter having a U-shaped member with legs extending away from the second angle arm and defining a gap therebetween, a threaded bolt extending through one of the legs into the gap between the legs for selectively engaging a structure extending through the gap.

* * * * *